US006181800B1

(12) United States Patent
Lambrecht

(10) Patent No.: US 6,181,800 B1
(45) **Date of Patent: *Jan. 30, 2001**

(54) SYSTEM AND METHOD FOR INTERACTIVE APPROXIMATION OF A HEAD TRANSFER FUNCTION

(75) Inventor: J. Andrew Lambrecht, Austin, TX (US)

(73) Assignee: Advanced Micro Devices, Inc., Sunnyvale, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/813,454

(22) Filed: Mar. 10, 1997

(51) Int. Cl.[7] ..... H04R 5/02
(52) U.S. Cl. ..... 381/310; 381/17
(58) Field of Search ..... 381/17, 18, 1, 381/303, 309, 310, 74, 63, 61, 56

(56) References Cited

U.S. PATENT DOCUMENTS 5,440,639 * 8/1995 Suzuki et al. ..... 381/17
5,495,534 * 2/1996 Inanaga et al. ..... 381/310
5,715,317 * 2/1998 Nakazawa ..... 381/309
5,742,689 * 4/1998 Tucker et al. ..... 381/309

* cited by examiner

*Primary Examiner*—Vivian Chang
(74) *Attorney, Agent, or Firm*—Conley, Rose & Tayon PC; Jeffrey C. Hood; Eric A. Stephenson

(57) ABSTRACT

A head related transfer function (HRTF) is used to simulate positional three-dimensional sound. The HRTF accounts for the frequency response, delays and reflections of the human body. The HRTF is unique to each individual and is affected by the shape and size of the head, the shape and size of the pinnae, the characteristics of the ear canal and the relationships of the shoulder to the ear. An HRTF for an individual is interactively approximated by first choosing a generalized HRTF. A computer, or other device, outputs audio signals from fixed locations using the generalized HRTF. Although the sound is output from fixed positions, a user may be expected to perceive the sound from a position different than the fixed position from which the sound is output. The user inputs the actual perceived position of the sound to the computer. The computer calculates positional errors between the expected perceived position of the sound and the actual perceived position of the sound. The positional errors are used to either adjust the parameters of the current HRTF or select a new HRTF. The above process is repeated with an adjusted or new HRTF until the positional errors of the HRTF are within an acceptable range of error.

20 Claims, 3 Drawing Sheets

SYSTEM AND METHOD FOR INTERACTIVE APPROXIMATION OF A HEAD TRANSFER FUNCTION

BACKGROUND OF THE INVENTION

1. Field of the Invention

The present invention relates to simulated three-dimensional audio and, more particularly, to head related transfer functions.

2. Description of the Relevant Art

Head related transfer functions (HRTFs) are used to simulate positional three-dimensional (3-D) sound using fixed speaker locations. The shape of the human head, body and auditory system affect how the brain perceives the position of sound sources. An HRTF is a characterization of the human head, body and auditory system. The HRTF primarily accounts for the frequency response, frequency filtering, delays and reflections inherent in the human head, body and auditory system. By adjusting the frequency and delays of audio signals according to the HRTF, three-dimensional sound can be simulated from fixed speaker locations.

The HRTF for each individual is unique. As mentioned above, the HRTF characterizes the human head, body and auditory system. The HRTF is affected by the size and shape of the head, the size and shape of the pinnae, the characteristics of the ear canal, and the relationship of the shoulder to the ear. A unique HRTF can be calculated for each individual by performing detailed and time consuming measurements of the head, ear and body. The measurements taken for an individual are converted to a transfer function usable by a processing device to adjust the characteristics of audio signal outputs to individual speakers to simulate positional three-dimensional sound.

The detailed measurements required to determine the HRTF of an individual are time consuming and require special purpose equipment. Determining the HRTF of an individual by taking measurements is suitable for low volume special purpose applications where accuracy is important and cost is relatively unimportant. Taking individual measurements to determine an HRTF, however, is not suitable for high volume applications in which cost is a primary concern, e.g., computer games. Computer games may use HRTFs to simulate positional 3-D sound. Because the HRTF is different for each individual, determining the HRTF for each individual user of a computer game would require making detailed time consuming measurements of each user using special purpose equipment. This, of course, is not practical for widely distributed computer games.

A common alternative to individualized HRTFs in high volume applications is the use of a generalized HRTF. A generalized HRTF is an average HRTF. The generalized HRTF is an attempt to define an HRTF that is effective for a large percentage of the population. The generalized HRTF works well for some portion of the population, works poorly for some percentage of the population and may not work at all for some portion of the population. Therefore, a general HRTF is a marginal solution to the problem of selecting an effective HRTF for high volume applications.

Another solution for determining individual HRTFs in high volume applications is to define a finite number of lesser-generalized HRTFs. Each lesser-generalized HRTF consists of various combinations of head, pinnae, and auditory canal characteristics. These HRTs are referred to as lesser generalized HRTs because they are an average HRTF for a subset of the general population. Each lesser-generalized HRTF is suited for some portion of the population and therefore the combination of lesser-generalized HRTFs provide increased accuracy and performance for a wide range of the population. Unfortunately, it is difficult to determine which of the HRTFs is the most appropriate, or the best fit, for an individual user. Measurements of the head, ear and body typically must be made to determine the most appropriate HRTF for each user. Although these measurements may be less detailed and time consuming than the measurements to define an individualized HRTF, the measurements to determine the most appropriate HRTF are too detailed and time consuming to be practical for high volume applications. Additionally, the measurements may require specialized equipment not readily available to individual users.

What is desired is a system and method for accurately selecting or adjusting an HRTF for an individual without requiring detailed measurements of the individual.

SUMMARY OF THE INVENTION

The present invention contemplates an interactive method of selecting the best fit HRTF. A computer, or other device, starts with a generalized HRTF or one of a set of predetermined lesser-generalized HRTFs. The computer outputs audio signals that simulate sound at one or more positions using the generalized HRTF. User inputs to the computer indicates the perceived position of the sound. The computer determines the positional errors between the expected perceived position of the sound and the actual perceived position of the sound. The positional errors are used either to adjust the parameters of the generalized HRTF or select a new HRTF. This process of outputting audio signals, inputting the perceived position of the sound, calculating positional errors and selecting or adjusting the HRTF is repeated until the positional errors are within an acceptable range. The present invention thus advantageously provides a means of providing the mass market with a more accurate positional three-dimensional solution without performing detailed measurements requiring special purpose equipment.

Broadly speaking, the present invention contemplates a system for approximating a head related transfer function including a control unit, one or more speakers, and an input device. The control unit includes a storage device that stores one or more head related transfer functions. The speakers and input device are coupled to the control unit. The control unit outputs audio signals to the speakers or headphones using one of the stored head related transfer functions. An actual perceived position of the sound is input to the control unit via the input device. The control unit either adjusts one or more parameters of the head related transfer function or selects a new head related transfer function based on the actual perceived position of the sound.

The present invention further contemplates a method for interactive approximation of a head related transfer function including: selecting a first head related transfer function; outputting sound at one or more expected perceived positions using the first head related transfer function; receiving input from a user indicative of one or more actual perceived positions of the sound; and calculating positional errors between the one or more expected perceived positions of the sound and the one or more actual perceived positions of the sound. If the positional errors are within the acceptable error range, the first head related transfer function is used. If the positional errors are not within an acceptable error range, either one or more parameters of the first head related transfer function are adjusted or a new head related transfer function is selected. The above method is preferably iteratively repeated until the positional errors are in the acceptable error range.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE DRAWINGS

Figure 1:
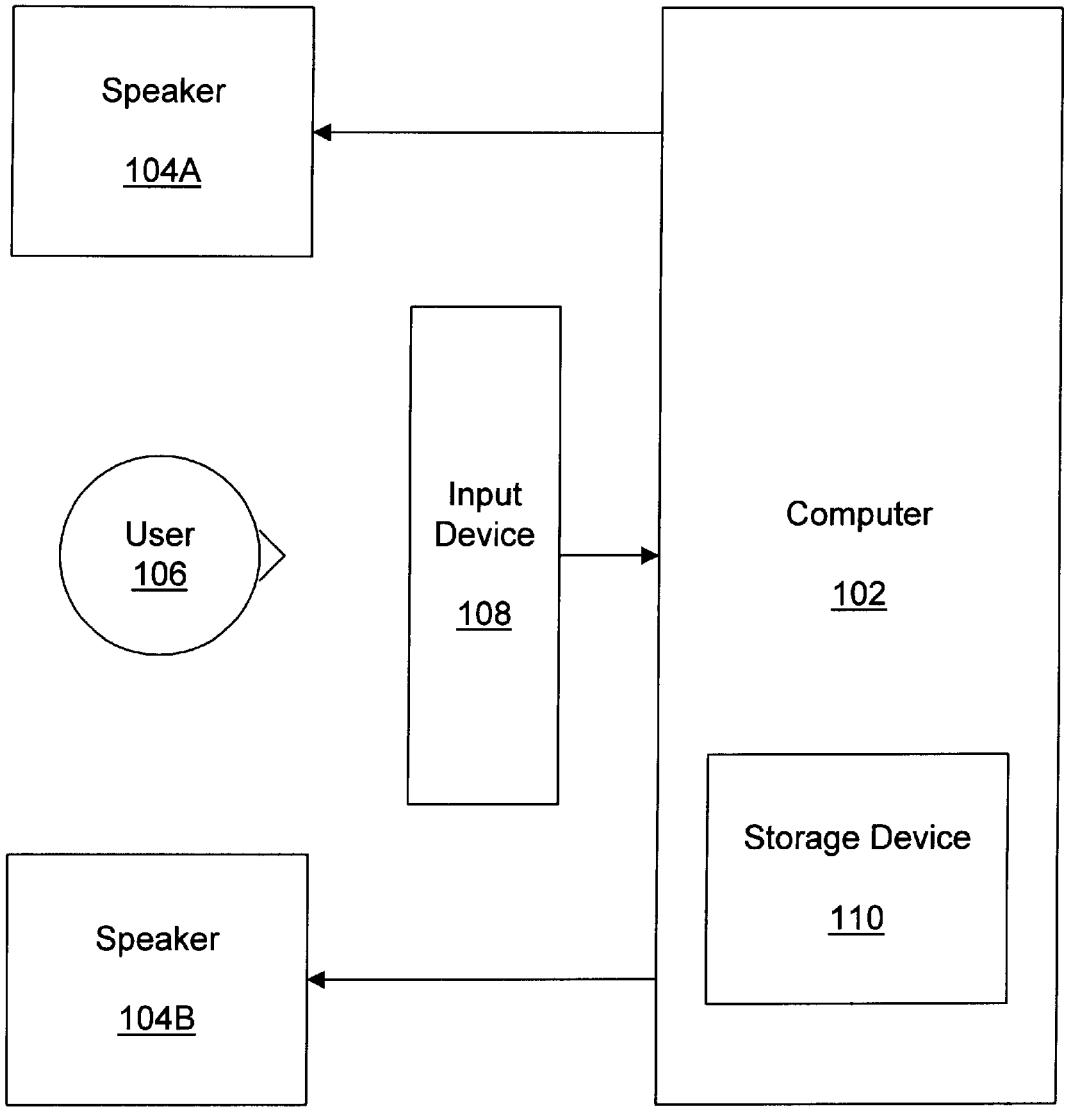
FIG. 1 is a block diagram of one embodiment of an apparatus for interactively approximating a head related transfer function according to the present invention.

Referring now to FIG. 1, a block diagram of one embodiment of a system for interactively approximating a head related transfer function (HRTF) according to the present invention is shown. The apparatus includes a computer 102, speakers 104A and 104B, and an input device 108. Computer 102 is coupled to provide an audio output to speakers 104A and 104B. Input device 108 is coupled to provide an output to computer 102. Computer 102 includes a storage device 110. Storage device 110 may be any conventional device for storing data. For example, storage device 110 may be a read only memory, a random access memory, or a non-volatile storage device, such as a hard disk or optical storage device. Storage device 110 stores one or more HRTFs.

Computer 102 is preferably a PC (personal computer), but may comprise a workstation, network PC, television, stereo unit, a microprocessor based system, a digital signal processor based system, digital logic, analog circuitry, other device which generates audio signals, or combinations thereof. For example, computer 102 may be the combination of a stereo unit and a PC, or a portable audio device and a PC. Although the terms "computer" or "control unit" are used throughout the specification, any device capable of outputting audio signals and calculating positional errors is contemplated.

Computer 102 begins by selecting an HRTF from the HRTFs stored in storage device 110. In one embodiment, computer 102 selects a generalized HRTF from storage device 110. As mentioned above, a generalized HRTF is an average HRTF which attempts to provide an effective HRTF for a large percentage of the population. A generalized HRTF may be a "most-generalized" HRTF which attempts to provide an effective HRTF for the largest possible segment of the population, or a "less-generalized" HRTF which attempts to provide an effective HRTF for some subset of the general population. Less-generalized HRTFs are typically used in groups to provide coverage for a larger portion of the population then one mosy-generalized HRTF. For the purposes of this specification, the term "generalized HRTF" refers to any HRTF that attempts to provide an effective HRTF for some segment of the population and includes both most-generalized and less-generalized HRTFs.

Computer 102 outputs audio signals to speakers 104A and 104B using the selected HRTF. In the illustrated embodiment, two speakers are employed. It is apparent, that more than two speakers may be employed. Speakers 104A and 104B may be part of a headphone set. For the purposes of this specification, the term "speakers" or "two or more speakers" includes headphones. Although the system illustrated in FIG. 1 can only output sound from the fixed speaker locations of speakers 104, the HRTF allows the system to simulate sound from positions other than the fixed positions of the speakers. Therefore, user 106 may perceive the sound as coming from a position other than the fixed position of the speakers. If the generalized HRTF employed by computer 102 is appropriate for user 106, user 106 will perceive the sound as coming from the position intended by computer 102. If the HRTF is not appropriate for user 106, then user 106 will perceive the sound at a different position than that intended by computer 102. An HRTF may be effective for some simulated positions, but not others. To determine the full extent of the effectiveness of an HRTF, the system may simulate sounds from multiple positions. It may then be determined whether user 106 perceives each sound at its intended position.

User 106 inputs the perceived position of the sound created by computer 102 via input device 108. Input device 108 may be any conventional device for inputting data to a computer. For example, input device 108 may be a keyboard, a mouse or other pointing device for selecting a graphical mechanism on a monitor, or a more accurate device, such as a virtual reality glove. When user 106 perceives the position of a sound output by the system of FIG. 1, user 106 indicates the perceived position via input device 108. If the system outputs multiple sounds, user 106 inputs the perceived position for each sound output by the system. Alternatively, computer 102 may output sound that "moves", i.e. sound that the user perceives to change position. User 106 may trace the motion of the perceived sound via input device 108, or may indicate the perceived final position of the sound via input device 108.

After user 106 has entered the perceived positions of the sound output by the system, computer 102 computes the positional errors of the perceived position of the sound. Generally speaking, the positional errors are the difference between the position at which computer 102 intends the sound to be perceived and the actual position perceived by user 106. When computer 102 outputs audio signals to speakers 104A and 104B using an HRTF, computer 102 intends the sound to be perceived by user 106 at a certain position. This position is referred to as the expected perceived position of the sound. Due to inaccuracies between the appropriate HRTF for user 106 and the current HRTF employed by computer 102, user 106 may perceive the sound from speakers 104A and 104B at a different position than the expected perceived position. The position at which user 106 actually perceives the sound is referred to as the actual perceived position of the sound. Computer 102 compares the expected perceived position of the sound to the actual perceived position of each sound. The difference between the expected perceived positions and the actual perceived positions are the positional errors for that HRTF as applied to user 106.

The positional errors detected by computer 102 are compared to an acceptable range of positional errors. The acceptable range of positional errors may vary depending on the desired accuracy of the simulated positional 3-D sound. In one embodiment, if the positional errors are within an acceptable range of error, the current HRTF is used. In another embodiment, if the positional errors are within an acceptable range of error, computer 102 continues to try to reduce the positional errors. If, however, computer 102 is not capable of further reducing the positional errors, then computer 102 uses the current HRTF.

In one embodiment, if the positional errors are not within the acceptable range of error, then the parameters of the current HRTF are adjusted. The parameters of an HRTF account for frequency response adjustments and delays. In one embodiment, computer 102 automatically adjusts the parameters based on the positional errors. After the parameters are adjusted, computer 102 outputs audio signals to speakers 104 using the adjusted HRTF. User 106 inputs the actual perceived position of the sound via input device 108. Computer 102 calculates the positional errors and compares those errors to an acceptable range of error. If the positional errors are still not within an acceptable range of error, the parameters of the HRTF are again adjusted and the above process is repeated until the positional errors are in an acceptable range of error, or it is determined that the positional errors have been sufficiently minimized.

In another embodiment, if the positional errors calculated by computer 102 are not within an acceptable range of error, computer 102 selects a new HRTF from a plurality of HRTFs stored in storage device 110. Alternatively, user 106 selects the new HRTF. Computer 102 outputs audio signals using the new HRTF. User 106 inputs the actual perceived position of the sound, and computer 102 calculates the positional errors. If the positional errors are still not within the acceptable range of error, yet another HRTF is selected from storage device 110. The above process of outputting audio signals, inputting the perceived position, calculating positional errors, and selecting a new HRTF from storage device 110 is repeated until an HRTF that produces positional errors within an acceptable range of error is found. In one particular embodiment, if an HRTF that produces positional errors within an acceptable range of error is not found, an HRTF with minimal positional errors is selected. In still another embodiment, the parameters of the HRTF with minimal positioned errors are adjusted to further reduce the positional errors of the HRTF.

Figure 2:
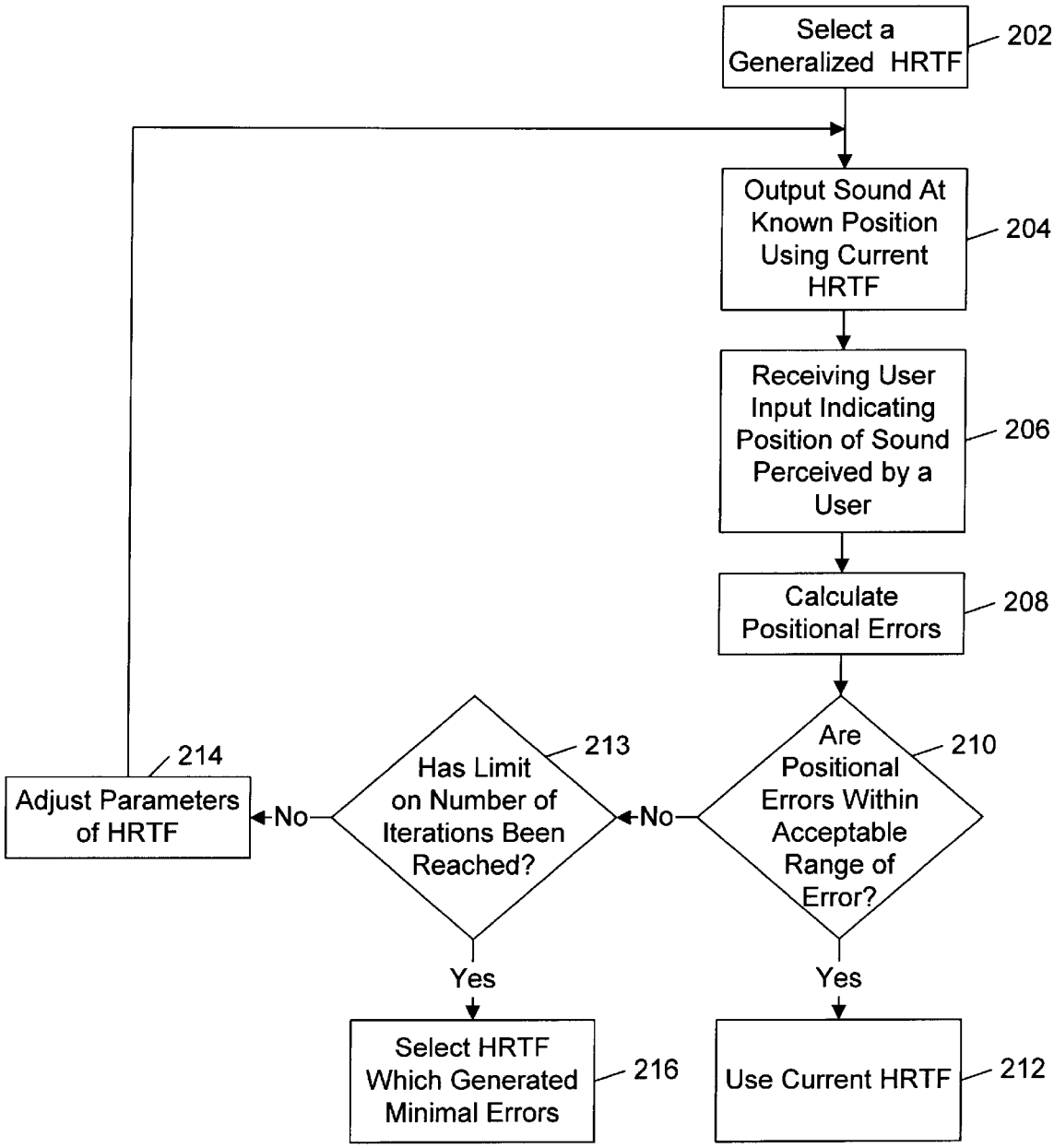
FIG. 2 is a flowchart diagram of a method for interactively approximating a head related transfer function according to the present invention.

Turning now to FIG. 2, a flowchart diagram illustrating a method for interactively approximating a head related transfer function according to the present invention is shown. In step 202, a generalized HRTF is selected as a current HRTF. In step 204, sound is output at one or more known positions using the current HRTF. The current HRTF is either the generalized HRTF selected in step 202 or an adjusted HRTF from step 214. The sound is output from at least one, and typically two fixed positions. Although the sound is from fixed positions, the HRTF simulates positional 3-D sound. The position at which the output sound is expected to be perceived is called the expected perceived position of the sound. A user perceives the position of the sound and inputs that position. This position is called the actual perceived position of the sound. In step 206, computer 102 receives the user input indicating the perceived position of the sound. In step 208, the positional error between the expected perceived position of the sound and the actual perceived position of the sound is detected. If sounds from multiple positions were output, positional errors are calculated for each expected perceived position. In step 210, the positional errors are compared with an acceptable range of error. If the positional errors are within an acceptable range of error, then in a step 212 the current HRTF is used. If in step 210, the positional errors are not within an acceptable range of error, then the number of iterations of adjusting the HRTF parameters are compared to an iteration limit. In order to prevent infinite adjustments of an HRTF in the event that the positional errors do not converge, an optional limit on the number of iterations may be applied. If the number of iterations of adjusting the HRTF parameters does not equal the iteration limit or no iteration limit is set, then in step 214 the parameters of the HRTF are adjusted and operation continues at step 204. If the iteration limit for adjusting the HRTF parameters has been reached, then in step 216, then an HRTF with minimal positional errors is selected. In an alternative embodiment, steps 204, 206, 208, 210 and 214 are iterativele repeated until the adjusted HRTF produces positional errors within an acceptable range of error.

Figure 3:
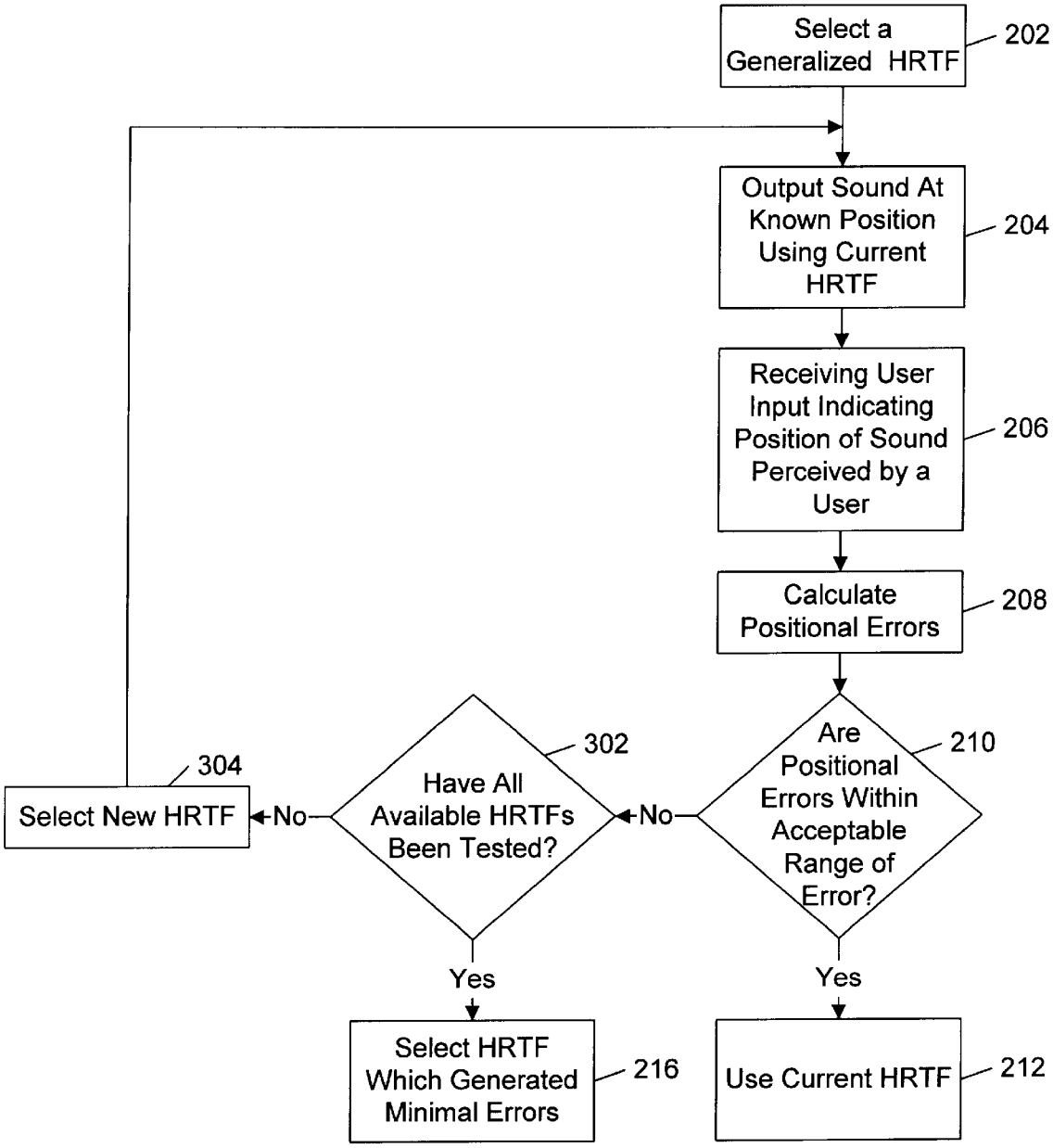
FIG. 3 is a flowchart diagram of another method for interactively approximating a head related transfer function according to the present invention.

Turning now to FIG. 3, a flowchart diagram of another embodiment of a method for interactively approximating a head related transfer function is shown. Steps which are similar or identical to those in FIG. 2 have the same reference numerals for convenience. In this embodiment, computer 102 stores a plurality of HRTFs. As discussed above, in step 202 a generalized HRTF is selected. In step 204, sound is output at one or more known positions using the HRTF. In step 206, computer 102 receives a user input indicative of the actual perceived position of the sound. In step 208, positional errors are calculated. In step 210, the positional errors are compared to an acceptable error range. If the positional errors are within an acceptable error range, then in step 212 the current HRTF is used. If the positional errors are not within an acceptable range error, then in decisional step 302 it is determined whether all HRTF's stored by computer 102 have been tested. If not all the HRTFs have been tested, then in step 304 a new HRTF is selected and operation continues at step 204. If all the HRTF's have been tested, then in step 306, an HRTF with minimal positional errors is selected. Steps 204, 206, 208, 210 and 302 304 are preferably iteratively repeated until an HRTF that produces positional errors within an acceptable error range is selected or all HRTFs have been tested. In one embodiment, if an HRTF that produces positional errors within an acceptable error range is not found, an HRTF with minimal position errors is used. In another embodiment, if an HRTF that produces positional errors within an acceptable error range is not found, the parameters of the HRTF with minimal positional errors are adjusted in a manner similar to that discussed above with relation to FIG. 2.

Although the system and method of the present invention has been described in connection with one or more preferred embodiments, it is not intended to be limited to the specific form set forth herein, but on the contrary, it is intended to cover such alternatives, modifications, and equivalents, as can be reasonably included within the spirit and scope of the invention as defined by the appended claims.

What is claimed is:

1. A system comprising:

a control unit comprising a storage device which stores a first head related transfer function, wherein said first head related transfer function comprises a set of parameters;

speakers coupled to the control unit, wherein a first speaker and a second speaker are positioned at first and second positions, respectively;

an input device coupled to said control unit;

wherein said control unit is configured (a) to generate first audio signals as a function of the parameters of said first head related transfer function, (b) to supply said first audio signals to said first and second speakers;

wherein said first and second speakers generate sound in response to said first and second speakers receiving said first audio signals;

wherein said control unit generates said first audio signals such that the sound generated in response to said first and second speakers receiving said first audio signals is desired to appear to originate at an expected perceived position;

wherein said input device is configured to receive user input information relating to an actual perceived position, wherein the user input information is input to the input device in response to the first and second speakers generating sound;

wherein said control unit is further configured (c) to compute a positional error, wherein said positional error is the difference between said expected perceived position and said actual perceived position, and (d) to adjust the parameters of said first head related transfer function using said positional error.

2. The system of claim 1 wherein said control unit is configured to (a) generate adjusted first audio signals as a function of the adjusted parameters of the first head related transfer function, (b) supply said adjusted first audio signals to said first and second speakers for presentation to said user, (c) receive new user input information relating to a new actual perceived position from said user through said input device, (d) compute a new positional error, wherein said new positional error is the difference between said expected perceived position and said new actual perceived position, and (e) update the adjusted parameters of said first head related transfer function using said new positional error.

3. The system of claim 1 wherein said control unit is configured to compare the computed positional error with an acceptable error range.

4. The system of claim 1 wherein said first head related transfer function is a generalized head related transfer function which represents an average of head, body and auditory system characteristics for a first group of humans.

5. A system comprising:

a control unit comprising a storage device which stores a plurality of head related transfer funtions, wherein each of said head related transfer functions comprises a set of parameters;

speakers coupled to the control unit, wherein a first speaker and a second speaker are positioned at first and second positions, respectively;

an input device coupled to said control unit;

wherein said control unit is configured (a) to select a first head related transfer function, (b) to generate first audio signals as a function of said first head related transfer function, (c) to supply said first audio signals to said first and second speakers for presentation to said user;

wherein said control unit generates said first audio signals such that the sound generated in response to said first and second speakers receiving said first audio signals is desired to appear to originate at an expected perceived position;

wherein said input device is configured to receive user input information relating to an actual perceived position, wherein the user input information is input to the input device in response to the first and second speakers generating sound;

wherein said control unit is further configured (d) to compute a positional error, wherein said positional error is the difference between said expected perceived position and said actual perceived position, and (e) to select a new head related transfer function from said plurality of head related transfer functions in response to computing the positional error.

6. The system of claim 5 wherein said control unit is configured to (a) generate adjusted first audio signals as a function of the adjusted parameters of the first head related transfer function, (b) supply said adjusted first audio signals to said first and second speakers for presentation to said user, (c) receive new user input information relating to a new actual perceived position, (d) compute a new positional error, wherein said new positional error is the difference between said expected perceived position and said now actual perceived position, and (e) select a new current head related transfer function in response to said new positional error.

7. The system of claim 5, wherein said control unit is configured to compare the computed positional error with an acceptable error range.

8. The system of claim 6, wherein said control unit compares said positional error and said new positional error and selects one of the first and second head related transfer functions in response to comparing said positional error and said new positional error.

9. The system of claim 8, wherein said control unit is further configured to (a) generate second audio signals which are a function of parameters of said new current head related transfer function, (b) supply said second audio signals to said first and second speakers for presentation to said user, (c) receive a second set of user input information relating to a second actual perceived position, (d) compute a set of positional errors based on parameters of said new current head related transfer function and said user input information relating to the second actual perceived position, and (e) update the current values of said parameters of said new current head related transfer function based on said positional error.

10. The system of claim 5, wherein at least one of said head related transfer functions is a generalized head related transfer function which represents an average of head, body and auditory system characteristics for a group of humans.

11. A method comprising:

choosing a first head related transfer function, wherein said first head related transfer function comprises a set of parameters;

generating first audio signals as a function of the parameters of a first head related transfer function;

supplying said first audio signals to a first speaker and second speaker positioned at first and second positions, respectively, for presentation to said user, wherein said first and second speakers are desired to generate sounds which appear to originate at an expected perceived position;

receiving user input information relating to an actual perceived position, wherein the user input information is input to the input device in response to the first and second speakers generating sound;

computing a positional error, wherein said positional error is the difference between said expected perceived position and said actual perceived position;

adjusting said parameters of said first head related transfer function if said positional error is not within an acceptable error range; and using said adjusted head related transfer function to generate second audio signals and presenting said second audio signals to said user through said first and second speakers if said positional error is not within said acceptable error range.

12. The method of claim 11 further comprising repeating said generating, said supplying, said receiving, said computing, and said adjusting until said set of positional errors are within said acceptable error range.

13. The method of claim 12 further comprising comparing a number of iterations of said adjusting of said one or more parameters to a limit on a number of iterations, and if said number of iterations equals said limit, a head related transfer function with minimal positional errors is selected.

14. The method of claim 11 wherein said first head related transfer function is a generalized head related transfer function representing an average of human head, body, and auditory system characteristics for a first group of humans.

15. A method for interactive approximation of a head related transfer function comprising:

choosing a first head related transfer function from a plurality of head related transfer functions, wherein said first head related transfer function comprises a set of parameters;

generating first audio signals as a function of said first head related transfer function;

supplying said first audio signals to a first speaker and a second speaker positioned at first and second positions, respectively, for presentation to said user, wherein said first and second speakers are desired to generate sounds which appear to originate at an expected perceived position;

receiving user input information relating to an actual perceived position, wherein the user input information is input to an input device in response to the first and second speakers generating sound;

computing a positional error, wherein said positional error is the difference between said expected perceived position and said actual perceived position;

selecting a new head related transfer function from said plurality of head related transfer functions if said positional error is not within an acceptable error range; and using said first head related transfer function to generate second audio signals and presenting said second audio signals to said user through said first and second speakers if said positional error is not within said acceptable error range.

16. The method of claim 15 further comprising repeating said generating, said supplying, said receiving, said computing, and said selecting until said positional error is within said acceptable error range.

17. The method of claim 16 further comprising choosing a head related transfer function which produces minimal positional error if said positional error associated with each of said plurality of head related transfer functions is not within said acceptable error range.

18. The method of claim 17 further comprising adjusting parameters of said head related transfer function which produces said minimal positional error until said positional error is within said acceptable error range.

19. The method of claim 15 wherein said first head related transfer function is a generalized head related transfer function representing an average of human head, body, and auditory system characteristics for a first group of humans.

20. A computer readable storage medium operable to:

select a first head related transfer function, wherein said head related transfer function comprises a set of parameters;

generate first audio signals as a function of said first head related transfer function;

supply said first audio signals to a first speaker and a second speaker positioned at first and second positions, respectively, for presentation to said user, wherein sounds generated by said first and second speakers are desired to appear to originate at an expected perceived position;

receive user input information relating to an actual perceived position, wherein the user input information is input to the input device in response to the first and second speaker generating sound;

compute a positional error, wherein said positional error is the difference between said expected perceived position and said actual perceived position;

adjust said parameters of said first head related transfer function if said positional error is not within an acceptable error range; and use said first head related transfer function to generate second audio signals and present said second audio signals to said user through said first and second speakers if said positional error is within said acceptable error range.

* * * * *

UNITED STATES PATENT AND TRADEMARK OFFICE

CERTIFICATE OF CORRECTION

PATENT NO. : 6,181,800 B1
DATED : January 30, 2001
INVENTOR(S) : J. Andrew Lambrecht It is certified that error appears in the above-identified patent and that said Letters Patent is hereby corrected as shown below:

Title page,
Item [54], please delete "A Head Transfer" and substitute -- Head Related Transfer --.

Claim 6, column 8,
Line 9, please delete "now" and substitute -- new --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*